United States Patent [19]

Meschi

[11] Patent Number: 4,650,447

[45] Date of Patent: Mar. 17, 1987

[54] RECEIVING, CUTTING AND PILING EQUIPMENT FOR STRIPS OF SHEET MATERIAL

[76] Inventor: Luciano Meschi, Corso Amedeo 73, 57100 Livorno, Italy

[21] Appl. No.: 724,532

[22] Filed: Apr. 18, 1985

[30] Foreign Application Priority Data

Apr. 26, 1984 [IT] Italy ..... 20692 A/84

[51] Int. Cl.[4] ..... B65H 45/28

[52] U.S. Cl. ..... 493/11; 493/412; 493/357; 83/648; 225/105

[58] Field of Search ..... 225/103, 105; 270/21.1, 270/39, 40, 52.5; 83/648; 493/11, 412, 410, 357

[56] References Cited

U.S. PATENT DOCUMENTS

| | | | |
|---|---|---|---|
| 3,301,111 | 1/1967 | Nystrand | 83/92 |
| 3,820,700 | 6/1974 | Quirijnen | 270/39 X |
| 3,937,452 | 2/1976 | Gäth | 270/39 |
| 3,991,993 | 11/1976 | Clouthier | 270/52.5 |
| 4,118,022 | 10/1978 | Rayfield et al. | 270/52.5 |
| 4,406,650 | 9/1983 | Felix | 493/410 |
| 4,508,527 | 4/1985 | Uno et al. | 493/357 |

*Primary Examiner*—Donald R. Schran

*Attorney, Agent, or Firm*—McAulay, Fields, Fisher, Goldstein & Nissen

[57] ABSTRACT

In equipment for receiving, cutting, piling and transfering in package form a continuous strip of sheets of forms deposited accordionwise coming from a printer cutting devices operating together with devices blocking the two sheets forming the pleat at which the cut will be made as well as reading devices which control said cutting devices in relation to a mark applied to said continuous strip are provided.

12 Claims, 5 Drawing Figures

RECEIVING, CUTTING AND PILING EQUIPMENT FOR STRIPS OF SHEET MATERIAL

The present invention relates to equipment for receiving, packaging and transferring strips of sheet material, in particular for the automatic formation of piles of the sheet material having a known height which is predetermined and variable depending on the requirements of the final user of the sheet material.

Equipment of this type is usually associated with fast printing machines (like the so-called "laser" printers) such as for example those used in accounting and electronic data processing departments. The function of this equipment is to receive the strip of sheet material coming from the printer and fold it accordionwise into a pile or package.

Equipment of this type is for example described in Italian patent application No. 25348 A/81 and basically provides means of entrainment capable of advancing the arriving strip in a controlled manner, guides which direct the strip onto a receiving and packing board to be deposited accordionwise on said board, and a cutting blade which engages the strip at the tear-off line preformed in the strip.

The equipment is designed in such a manner that the strip is cut each time the pile formed on the receiving board reaches a predetermined height constant for all the piles. For this purpose detectors are provided to control the cutting device.

Since during the cutting operation the supply of paper strip arriving from the printer continues at the same speed, the cutting device is associated with a temporary supporting board which receives the arriving strip above the actual cutter, in this manner allowing the cutter to perform the cutting operation without interfering with the arriving strip and removal of the pile thus completed from the receiving board, after which the temporary supporting board above the cutter is withdrawn and deposit and piling on the receiving board are resumed automatically.

A peculiar characteristic of the equipment in question lies in the fact that the pile of paper included between the receiving board and the abovesaid temporary supporting board before the cutting operation is subjected to compacting or pressing, which is shown to be important for satisfactory cutting.

On this point it is worthy of note that the paper strip arriving at the equipment in question is already printed by the printer so that damaging even a single sheet or form could bring on very serious inconveniences because it would make necessary seeking and reprinting of the data processed and printed on the damaged sheet.

Consequently, the operational security of the equipment in question is of the greatest importance for the entire line of work.

As already mentioned the equipment in question is programmed to make the cut when a certain number of sheets of the continuous strip have been piled on the receiving board, a number which is determined by devices which count for example the side holes formed in the continuous paper strip.

Often however there is a need to form piles of sheets of very different heights depending on the final user's requirements. For example, it is common for a number of printed forms substantially of the normal height of a complete pile (the height regularly predetermined for operation of the equipment) to be prepared for one user while a much smaller number of sheets is prepared for the user immediately following.

In this case, heretofore, it was necessary to form a pile of sheets identical to the others and then in a subsequent manual step divide the pile obtained in two or more groups of forms each for its respective user.

The main object of the present invention is to solve the problem briefly outlined above, that is provide equipment for receiving, piling and transferring a continuous strip of paper sheets or forms capable of automatically forming piles of sheets or forms of any number with no need of mechanical regulation and/or manual intervention.

Another equally important purpose of the present invention is to provide equipment of the aforesaid type simplified functionally and structurally.

Another object of the present invention is to provide equipment which will assure performance of the receiving and piling operation of the continuous strips of forms or sheets in such a way as to avoid damaging the sheets and forms.

These and other objects are achieved with equipment for receiving, piling and transferring a continuous strip of material in sheets in which the individual sheets are identified by tear-off lines of the type comprising entrainment devices which advance the arriving continuous strip in a controlled manner, guide devices which receive said strip and direct it onto a receiving and piling board and deposit said strip thereon with an accordionlike configuration in which the edges of the folds coincide with said tear-off lines, cutters which engage the strip at said tear-off lines, and a temporary support board for the arriving strip located upstream from said cutter but downstream from said guides, characterized in that it includes an auxiliary supporting board designed to interpose itself in the path of said continuous strip upstream from said temporary support board when the latter is in operating position, devices associated with said auxiliary supporting board to block the sheets which are instantaneously interposed between said temporary supporting board and said auxiliary supporting board against the temporary supporting board or against the auxiliary supporting board, devices for reading marks applied to the arriving strip, said marks indicating the beginning and/or end of an individual pile of sheets, and cutting operation control devices operated by said reading devices.

The peculiar aspects and advantages of the present invention will appear more clearly from the following description made with reference to the annexed drawings wherein.

Figure 1:
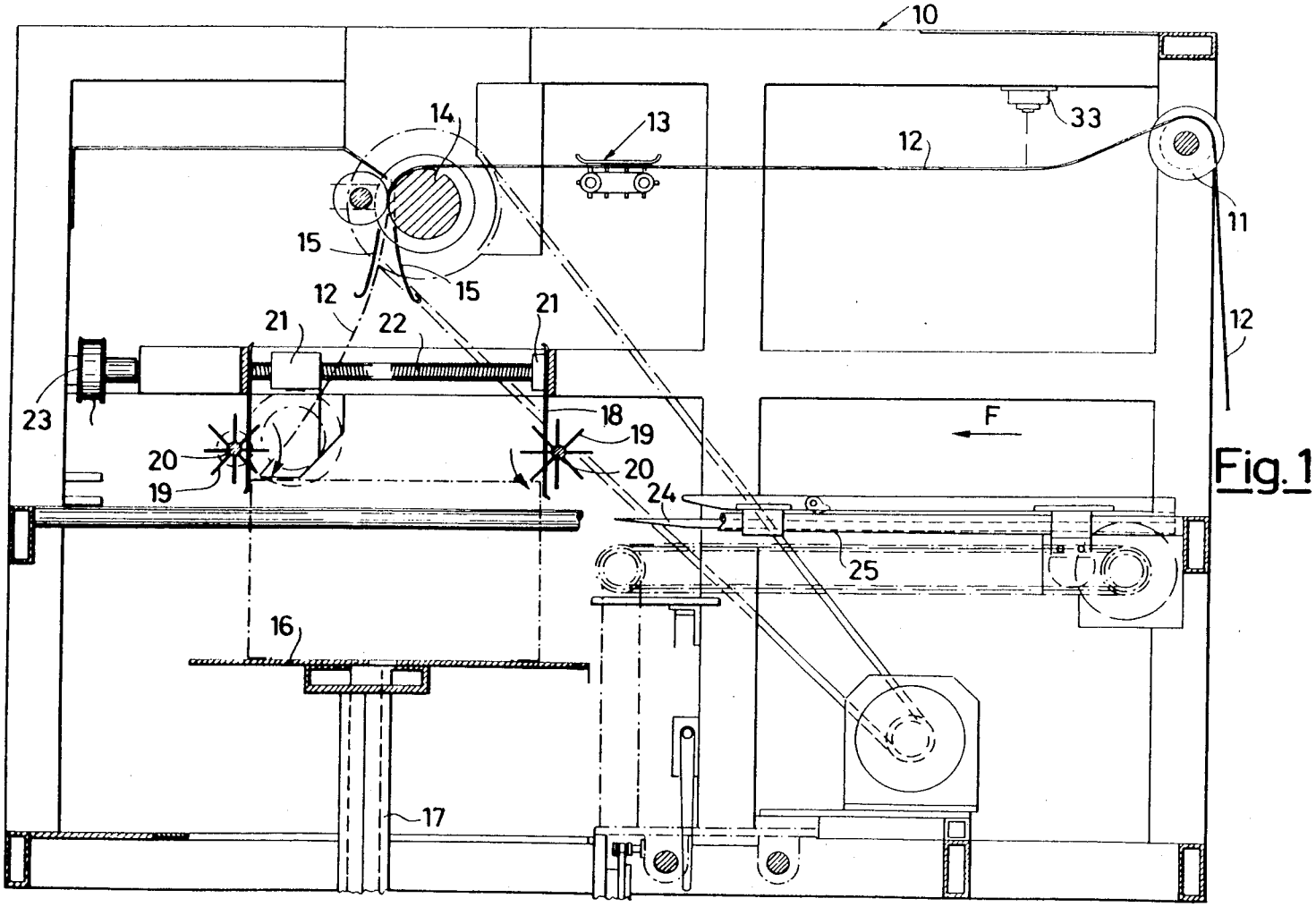
FIG. 1 is a schematic and partially sectional side view of a preferred embodiment of the equipment according to the present invention.
Figure 2:
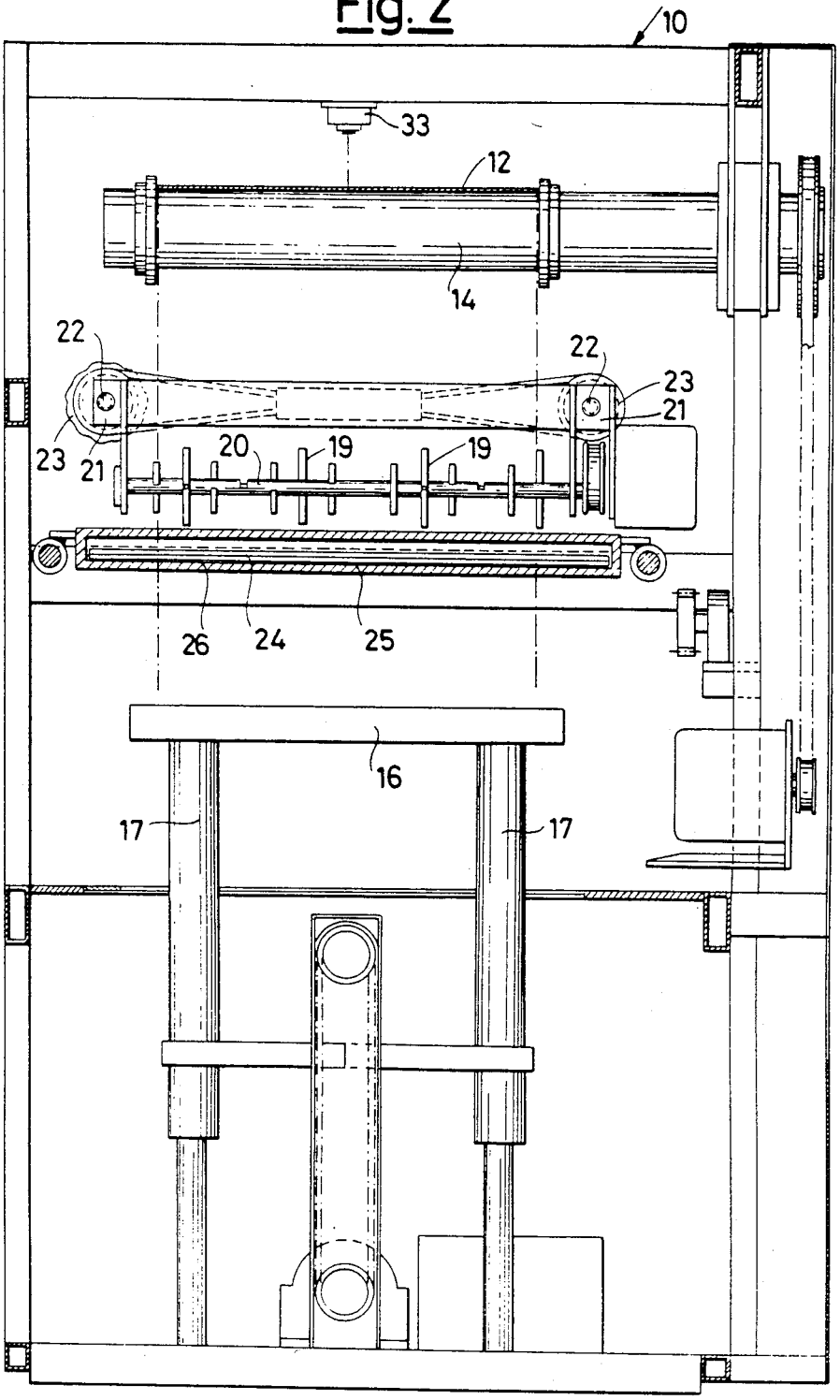
FIG. 2 is a view of the equipment of FIG. 1 seen from the direction of arrow F of FIG. 1.
Figure 3:
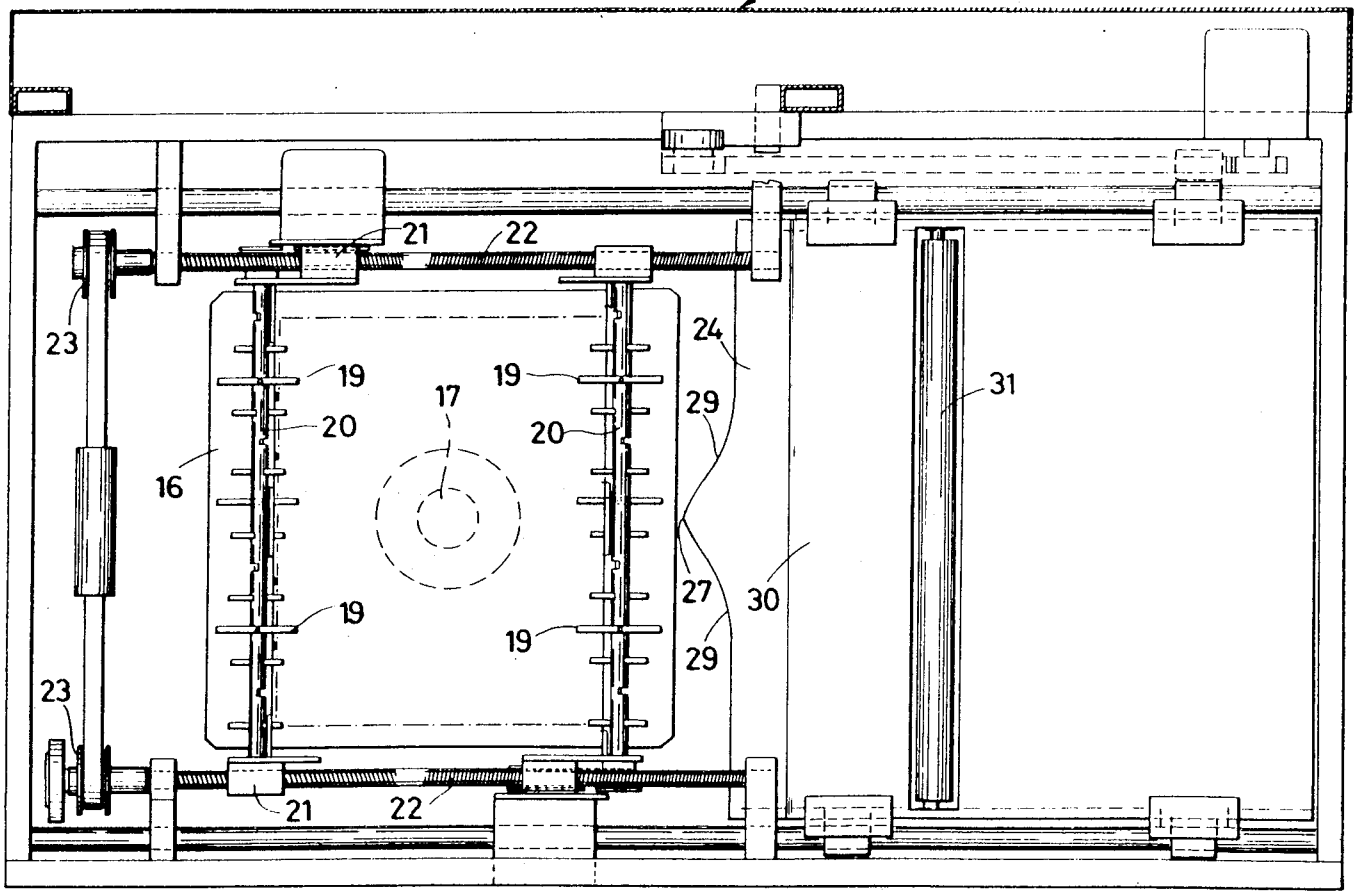
FIG. 3 is a partially sectional plan view from above of the equipment of FIG. 1.

Referring to the figures, the equipment according to the present invention comprises a frame 10 which has a roller 11 at which arrives a continuous strip 12 of material preferably in the form of sheets or forms identified by tear-off lines.

The strip 12 can be, for example, that arriving from a fast printer, like a laser type.

From the roller 11 the strip 12 reaches an entrainment or pulling device 13 of the conventional type and therefore not illustrated in detail which receives and advances the strip at a speed which can be regulated by means of said puller.

From the puller 13 the strip 12 goes to an idling roller 14 from which the strip is sent between two fixed deflectors 15 between which the strip falls on a receiving and piling board 16 mounted on a lifting and lowering piston 17, a cage 18 being provided to direct and contain the pile being formed.

The cage 18 is formed of spaced strips between which pass the blades 19 which are made preferably of flexible plastic material and mounted on two parallel shafts 20, the purpose of the blades 19 being to accompany and guide the strip of sheets 12 while they descend between the guides 15 and are deposited accordionwise on the board 16.

The two opposed sides of the cage 18 are movable relative to each other and are integral with the sleeves 21 which are in turn mounted in a sliding manner on a worn screw 22 operated by a geared motor 23 to regulate the dimensions of the cage 18 according to the size of the sheets or forms making up the continuous strip 12.

As the sheets progressively accumulate on the board 16 said board 16 must be lowered by degrees and this takes place in a programmed manner or under control of appropriate sensors, for example photoelectric cells located at an appropriate level. Each time the level of the pile of sheets being formed intercepts the light beam which activates the photoelectric cell, appropriate driving devices begin operating and lower the board 16 a predetermined distance.

To cut the continuous strip 12 when a pile of sheets of predetermined size has been formed or when the reading devices described below are activated, a cutting unit including a pair of plates 24 and 25 between which is interposed the cutting blade 26 is provided.

Figure 4:
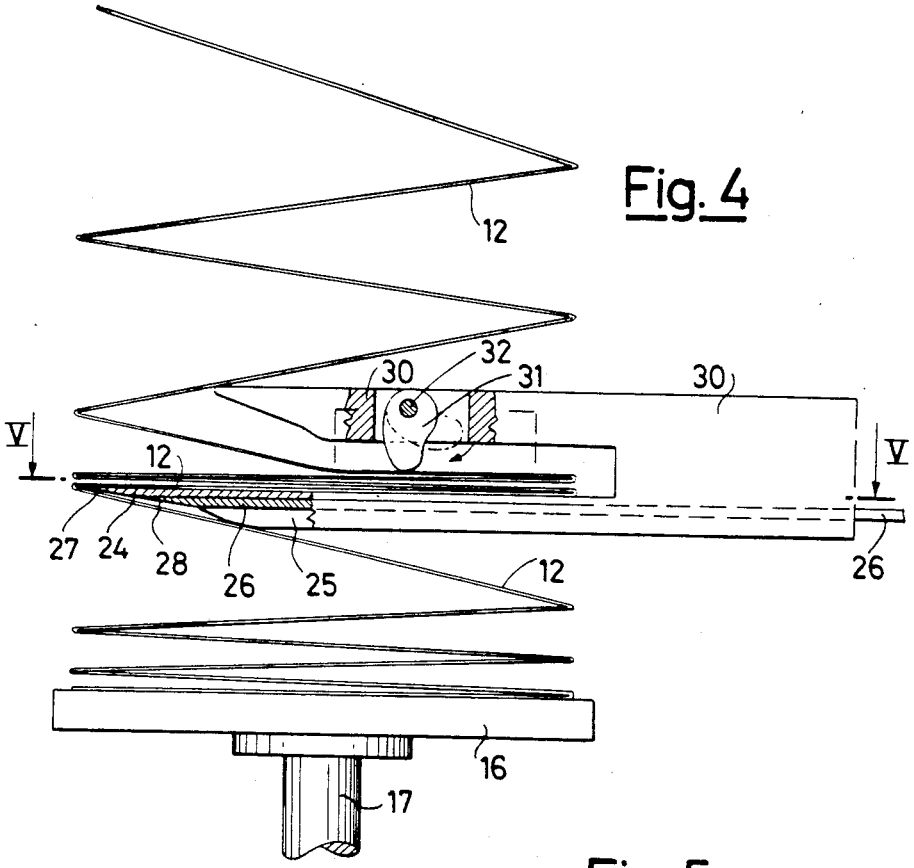
FIGS. 4 and 5 are detailed views respectively in a partially sectional side elevation and in plan of the cutting devices and the auxiliary supporting board.
Figure 5:
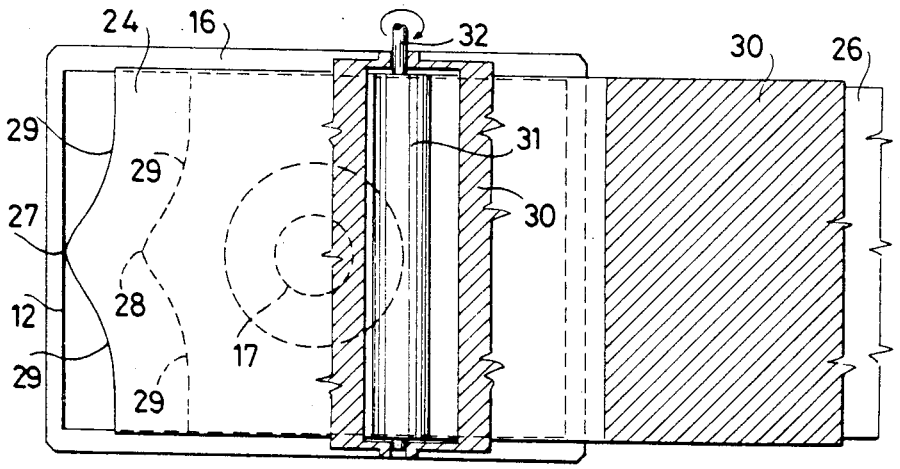

As can be seen in FIG. 4 the upper plate 24 extends continuously beyond the lower plate 25 and also beyond the blade 26 except when said blade 26 is operated for the actual cutting.

More specifically, both the upper plate 24 and the cutting blade 26 have a protruding part 29 indicated respectively by references 27 and 28 connected by curved dashed lines to the rest of the plate and the blade in order to avoid interference with their movement relative to the adjacent sheets, in such a manner that the plate 24, when it penetrates into the package of sheets being formed, is facilitated in that the first contact takes place at a single point in such a manner that the plate more easily opens its way between two directly superimposed sheets. The tip 28 of the blade 26 ensures that the cut begins at one point and procedes therefrom with 'paper-cutting' action.

The function of the lower plate 25 is to provide a fixed opposing surface for pressing or compacting by the lower piston 17, an operation which immediately precedes the actual cutting, which is radically facilitated because the blade acts on the pleat of the strip 12 at a tear-off line as already said with no possibility for the blade to displace the lower sheet without cutting.

In the equipment which is the object of the previous Italian patent application identified above, for cutting was provided an anvil element which opposed the movement of the blade, while above the temporary supporting board equivalent to the plate 24 described above the continuous strip arriving continued to be deposited accordionwise. When the cut was completed and with the withdrawal of the temporary supporting plate, the sheets already deposited on the latter fell flatly on the underlying supporting plate, which was now free. It is clear that when the number of sheets forming the pile or package to be separated is small compared with normal sizes (for example 200–300 sheets instead of 2000) even the compacting operation is inadequate to provide the resistance to displacement necessary for correct operation of the paper-cutting blade.

According to the present invention the problem is solved by providing not only compacting from below but also mechanical blocking of some sheets of the continuous strip above the temporary supporting plate so that the edge of the paper at which the cut takes place is held motionless by blocking both the lower and upper sheets which are joined together at said edge.

For this purpose, above the plate 24 is provided a second auxiliary plate 30 which is preferably rigidly integral with the plate 24 but offset rearward of the same in such a manner that the plate 30 operates with a certain delay relative to the plate 24. In this manner, when the plate 24 together with the plate 25 and the blade 26 opens its way into the package being formed, stopping at an edge, the plate 30 advances concomitantly with it. The offset distance of the plate 30 relative to the plate 24 provides that several sheets are deposited accordionwise between the two plates 24 and 30. The plate 30 has an integral eccentric 31 which is movable between a neutral nonoperating position and an operating or blocking position in which it rotates and blocks the above-said group of several sheets remaining between the plates 30 and 24 against the latter.

To operate the excentric is provided, for example, an oleopneumatic piston and cylinder which causes to rotate through a predetermined arc the shaft 32, on which is mounted rigidly the excentric 31, which has preferably a rubber outer surface.

At this point the operation of the cutting blade with well-known means such as for example a cylinder and piston assembly performs the cut at the edge of the strip mated with the front edge of the temporary separation plate.

As already mentioned, on the path of the strip 12 are provided readers indicated schematically by reference 33. Said readers are sensitive to a mark which the printer makes on the continuous strip 12 at the beginning and/or end of a certain number of sheets or forms.

For example, if to each user is assigned a reference mark, the appearance of that reference mark will be detected by the reader 33, which will activate with appropriate advance or delay the control activating the abovedescribed cutting device so that for each user will be formed on the collection board 16 a package or pile of sheets or forms folded accordionwise to be transferred as a unit.

Sensors are provided on the cage 18 such as those provided for in the aforesaid previous patent application in such a manner that the number of sheets which are accumulated on the board 16 does not exceed a predetermined maximum even if the reader 33 is not activated by the aforesaid marks.

In this case two or more piles or packages of sheets or forms are due to the user in question.

It is noted that in the general description of the equipment some components are not described in detail because they are the same as or equivalent to those described in the previous Italian patent application no. 25348 A/81 of the same applicant, compared with which, as is clear from the above description, the equipment according to the present invention achieves a considerable structural and functional simplification.

The invention has been described in relation to a preferred embodiment, it being understood that conceptually and mechanically equivalent modifications and variants are possible and foreseeable without going beyond its limits.

For example, blocking of the small group of sheets between plates 24 and 30 could take place equally well against plate 30, or the excentric 31 could be replaced by mechanical devices having the same function such as clamps.

I claim:

1. In equipment for receiving, piling and transferring a continuous strip of sheet material composed of individual sheets which are identified by tear-off lines, having:

pullers for advancing the continuous strip in a controlled manner;

guides for receiving the strip and directing thereof onto a receiving and piling board for depositing the strip thereon with an accordion-like configuration, the accordion-like configuration having folding edges which coincide with the tear-off lines on the continuous strip of sheet material;

cutting means for engaging the strip at one of the tear-off lines and severing the strip;

a temporary supporting board located upstream from said cutting means and between said cutting means and said guides for supporting one of two connected sheets for carrying out a cutting operation, and in which the improvement comprises:

an auxiliary supporting board movable into the path of the continuous strip when a cutting operation is to be carried out for interposition between adjacent sheets of the strip, said auxiliary supporting board being positioned above said temporary supporting board upstream thereof and said receiving and piling board;

means associated with said auxiliary supporting board for holding sheets, of the strip during movement of the strip towards said receiving and piling board, which sheets are instantaneously interposed between said temporary supporting board and said auxiliary supporting board, against either of said auxiliary supporting board or said temporary supporting board when said temporary supporting board and said auxiliary supporting board are moved into the path of the continuous strip when the cutting operation is to be carried out;

reading means for reading a mark carried on an arriving continuous strip, said mark indictating at least one of the beginning and end of an individual pile of sheets; and cutting control devices responsive to and operated by said reading means for controlling the operations of said cutting means to sever the adjacent sheets from each other when operated.

2. In the equipment of claim 1, wherein said cutting means comprises:

an assembly comprising two plates and a sliding cutting blade positioned between said two plates;

one of said plates being an upper plate and forming said temporary supporting board and the other of said plates forming a lower plate and cooperating with said receiving and piling board for compacting of sheets deposited thereon;

said upper plate extending beyond both said sliding cutting blade in one position thereof and said lower plate for initially engaging a pleat of the continuous strip along one of said tear-off lines at which the cut is to be made.

3. In the equipment of claim 2, wherein each of said upper plate, said lower plate and said cutting blade include a protruding tip and curved portions connecting said protruding tip to the rest of the front edges of the plates and the blade.

4. In the equipment of claim 1, wherein said auxiliary support plate is integral with said temporary supporting board and set back from it.

5. In the equipment according to claim 2, wherein said auxiliary support board is integral with said temporary supporting board and set back from it.

6. In the equipment according to claim 3, wherein said auxiliary support board is integral with said temporary supporting board and set back from it.

7. In the equipment according to claim 2, wherein said means for folding sheets includes an excentric fastened to said auxiliary supporting board and movable between a neutral or inactive position and an operative position in which it engages the upper surface of said upper plate blocking against it the sheets interposed between said upper plate and said auxiliary support board.

8. In the equipment according to claim 3, wherein said means for holding sheets includes an excentric fastened to said auxiliary supporting board and movable between a neutral or inactive position and an operative position in which it engages the upper surface of said upper plate blocking against it the sheets interposed between said upper plate and said auxiliary support board.

9. In the equipment according to claim 6, wherein said means for holding sheets includes an excentric fastened to said auxiliary supporting board and movable between a neutral or inactive position and an operative position in which it engages the upper surface of said upper plate blocking against it the sheets interposed between said upper plate and said auxiliary support board.

10. In the equipment according to claim 1, including sensors for sensing the maximum height of the pile of sheets being formed on said receiving and piling board for controlling said cutting means, said sensors being independent of said reading means sensitive to the marks applied to the arriving continuous strip.

11. In the equipment according to claim 9, including sensors for sensing the maximum height of the pile of sheets being formed on said receiving and piling board for controlling said cutting means, said sensors being independent of said reading means sensitive to the marks applied to the arriving continuous strip.

12. In the equipment according to claim 3, including sensors for sensing the maximum height of the pile of sheets being formed on said receiving and piling board for controlling said cutting means, said sensors being independent of said reading means sensitive to the marks applied to the arriving continuous strip.

* * * * *